US006612361B2

(12) United States Patent
Martellucci

(10) Patent No.: US 6,612,361 B2
(45) **Date of Patent: *Sep. 2, 2003**

(54) INGOT MOLD FOR CONTINUOUS CASTING OF MOLTEN METAL PARTICULARLY FOR FORMING RECTANGULAR-OR SQUARE-SECTION STEEL BILLETS

(75) Inventor: Giovanni Martellucci, Fornaci di Barga (IT)

(73) Assignee: Europa Metalli S.p.A., Florence (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/295,603

(22) Filed: Apr. 22, 1999

(65) Prior Publication Data

US 2001/0052407 A1 Dec. 20, 2001

(51) Int. Cl.[7] ..... B22D 11/04
(52) U.S. Cl. ..... 164/418; 164/459
(58) Field of Search ..... 164/418, 459, 164/420, 424

(56) References Cited

U.S. PATENT DOCUMENTS 4,207,941 A 6/1980 Shrum

FOREIGN PATENT DOCUMENTS

| | | | | |
|---|---|---|---|---|
| DE | 1293958 | | 4/1969 | |
| DE | 2616863 | | 1/1977 | |
| EP | 227154 | * | 3/1989 | ..... 164/418 |
| EP | 0498296 | | 1/1992 | |
| JP | 64-75146 | * | 3/1989 | ..... 164/418 |
| JP | 08243688 | | 9/1996 | |

OTHER PUBLICATIONS

EPO Search Report, May 20, 1989.
PCT Publication, WO96/33034, Oct. 1996.

* cited by examiner

*Primary Examiner*—M. Alexandra Elve
*Assistant Examiner*—Len Tran
(74) *Attorney, Agent, or Firm*—Liniak, Berenato & White

(57) ABSTRACT

A substantially rectangular-section casting conduit of an ingot mold, for continuous casting of molten metal, is divided into two portions; a first portion has a variable inner section, by having rounded inner edges with a radius of curvature decreasing gradually in the flow direction of the molten metal along the conduit; the second portion is consecutive with the first portion, and has a constant inner section with rounded inner edges of a predetermined optimum radius of curvature for subsequent rolling operations. The design of the first portion of the casting conduit prevents the metal, as it cools and contracts through the conduit, from detaching from the walls, and in particular from the edges, of the mold, thus enabling an increase in casting speed with no fall in product quality.

14 Claims, 1 Drawing Sheet

INGOT MOLD FOR CONTINUOUS CASTING OF MOLTEN METAL PARTICULARLY FOR FORMING RECTANGULAR-OR SQUARE-SECTION STEEL BILLETS

The present invention relates to an ingot mold for continuous casting of molten metal, particularly for forming rectangular- or square-section steel billets.

BACKGROUND OF THE INVENTION

Billets or ingots may be formed from molten metal, particularly steel, by continuous casting of the molten metal in a conduit-shaped mold (ingot mold) followed immediately by rolling (so-called "casting and direct rolling" technique). While enabling fairly high output speeds and good-quality products, this technique currently poses several drawbacks—mainly due to the process whereby the molten material is cooled and solidified in the mold—which limit the maximum output speed obtainable and the range of products that may be produced from the same mold.

That is, excessively fast casting in a continuous ingot mold—through which the molten material is cooled and starts solidifying—is known to result in the formation of defects in the finished product. More specifically, cooling, which occurs by the molten material yielding heat to the walls of the mold, is only fully effective if the material remains in contact with the walls, so that a surface layer of solid metal (so-called "skin") is formed and gradually increases as the material travels through the mold. As it solidifies, however, the material contracts and is detached from the walls, particularly the inner edges, of the mold, so that air pockets are formed between the metal skin and the mold wall, thus reducing the amount of heat given off, and slowing down the solidification process. The metal skin (solid layer) therefore continues growing, except at the corners, where insufficient heat is subtracted, thus resulting in only partial solidification of the molten metal and in the formation of defects in the finished product.

This also increases the likelihood of cracks forming at the edges, due to undesired stress on the metal skin as it withdraws from the wall of the mold.

In short, the resulting billet is of poor torsional strength, is highly susceptible to the formation of longitudinal cracks along the edges, and has a very uneven skin temperature, all of which create problems at the subsequent rolling stage and invariably impair the quality of the finished product.

To overcome these drawbacks, a relatively low casting speed is maintained to enable the material to cool as uniformly as possible. Also, reducing the radius of curvature of the inside corners of the mold is known to reduce the formation of air pockets, again providing casting speed is not too high.

When casting only one type of material, detachment of the metal skin from the mold walls may be reduced by improving the geometry of the mold, e.g. using appropriately tapered molds. This solution, however, cannot be applied to molds for producing materials of different characteristics (e.g. different types of steel).

Finally, some known molds have a particular, e.g. concave-walled, section for the passage of the molten metal. While reducing the problem of detachment, however, this type of mold also fails to provide for increasing casting speed over and above certain limits.

SUMMARY OF THE INVENTION

It is an object of the present invention to provide an ingot mold for continuous casting of metal materials, designed to overcome the aforementioned drawbacks typically associated with known molds. In particular, it is an object of the invention to provide an ingot mold enabling effective cooling of the molten metal at all points and along the whole length of the mold, to prevent detachment of the metal from the walls, even from the edges, of the mold, and to enable high-speed casting of top-quality products allowing of immediate rolling.

According to the present invention, there is provided an ingot mold for continuous casting of molten metal, in particular for forming rectangular- or square-section steel billets, comprising a longitudinally elongated casting conduit through which said molten metal flows and is cooled; said casting conduit having a substantially rectangular cross section, and being defined by a first and a second pair of substantially parallel, side by side walls; said first and said second pair of walls being substantially perpendicular to one another, and defining four inner edges; characterized in that said casting conduit comprises at least a first portion having rounded inner edges and an inner section varying gradually from a respective longitudinal first end, at which said molten metal is fed in, towards a respective longitudinal second end opposite the first; said variation in section of said at least a first portion being determined by a corresponding continuous, gradual variation in the radius of curvature of said rounded inner edges; said radius of curvature decreasing from a maximum value at said first end, to a minimum value at said second end.

More specifically, said variation in section of said at least a first portion of said casting conduit is such as to reproduce a thermal contraction of said molten metal as it travels through said at least a first portion.

The particular design of the ingot mold according to the present invention provides for effectively cooling the molten metal at all the surface points, even at the inner edges, and along the whole length of the mold. The material, in fact, is maintained contacting the walls, even at the edges, of the mold at all times, by virtue of the particular inner section of the variable-section portion, which in point of fact reproduces the cooling pattern of the material as it cools and solidifies.

The metal is thus prevented from detaching from the walls, even from the edges, of the mold, with no need to maintain an excessively low casting speed. Cooling inside the mold according to the invention is so effective as to enable immediate direct rolling of the product issuing from the conduit, with no need for any intermediate processing, by virtue of the material having the required characteristics (in particular, no internal stress at the edges, and an even skin temperature). Moreover, the same mold may be used for different materials, e.g. for producing different types of steel, while at the same time ensuring high-quality products and maintaining a high output speed.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
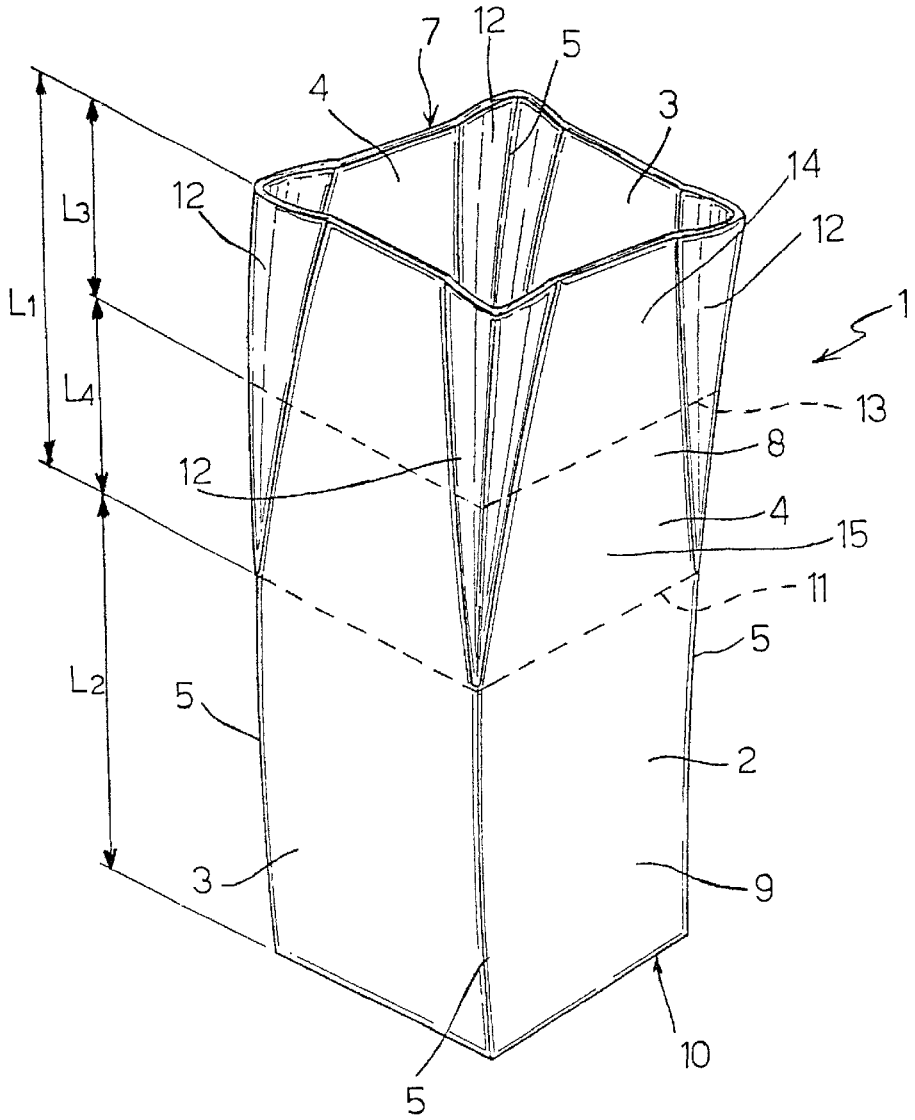
FIG. 1 shows a schematic view in perspective of an ingot mold for continuous casting of molten metal in accordance with the present invention.
Figure 2:
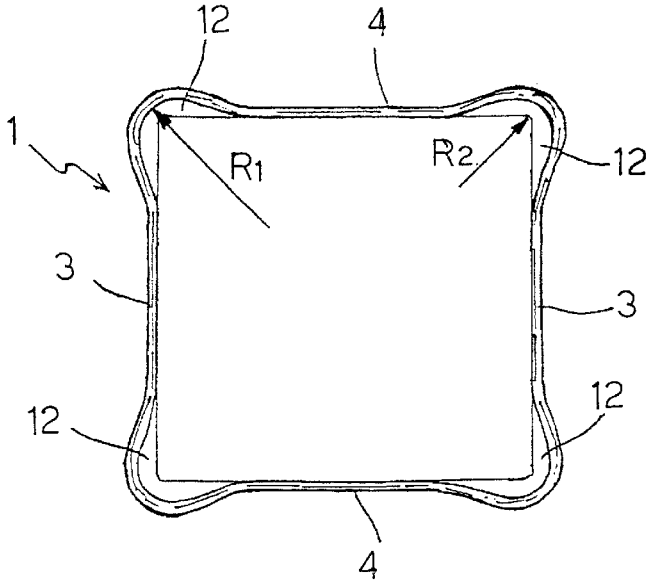
FIG. 2 shows a schematic plan view of the molten metal inlet section of the FIG. 1 mold.

In FIGS. 1 and 2, in which the parts are deliberately shown greatly out of proportion to highlight the main characteristics of the invention, number 1 indicates as a whole an ingot mold for continuous casting of molten metal, e.g. steel, in the form of rectangular-section billets.

Mold 1 comprises a longitudinally elongated casting conduit 2 through which the molten metal flows; conduit 2 has a substantially rectangular cross section, and is defined by a first pair 3 and a second pair 4 of substantially parallel, side by side walls of predetermined size; and pairs of walls 3 and 4 are perpendicular to one another and define four edges 5.

In the non-limiting example shown in FIG. 1, conduit 2 is curved, by walls 3 being flat and walls 4 having a predetermined curvature, but may obviously be of a longitudinal shape other than that described, e.g. straight. Whichever the case, conduit 2 extends substantially in a predetermined direction parallel to the pair of flat walls 3.

According to the present invention, conduit 2 comprises, as of a respective first longitudinal end 7 at which the molten metal is fed in, a first portion 8 with a variable inner section; and a consecutive second portion 9 with a constant inner section and terminating at a second end 10 of conduit 2 at which the molten metal is fed out. First portion 8 extends longitudinally by a predetermined length up to a respective second end 11 defined by an intermediate section of conduit 2, which is at once the section at which the molten metal is fed out of first portion 8, and the section at which the molten metal is fed into second portion 9.

Edges 5 defined by pairs of walls 3 and 4 are rounded internally along the whole length of conduit 2; the radius of curvature of edges 5 varies gradually along first portion 8, decreasing continuously from a maximum value $R_1$ at end 7 to a minimum value $R_2$ at the opposite end 11, and maintains a constant value of $R_2$ along the whole length of second portion 9; and the selected minimum value $R_2$ of the radius of curvature of edges 5 is the best value by which to subsequently roll the metal issuing from casting conduit 2.

The gradual variation in the radius of curvature of edges 5 along first portion 8 produces a corresponding gradual variation in the section of portion 8. More specifically, said variation in section is obtained by means of respective funnel-shaped portions 12 at the four edges 5 of portion 8: the four funnel-shaped portions 12 project transversely beyond walls 3 and 4, extend longitudinally from end 7 to end 11 of portion 8, and taper towards end 11 of portion 8, which, though defined by pairs of parallel walls 3 and 4, therefore has, as stated, an inner section varying longitudinally and decreasing in area from end 7 to end 11.

At end 11, portion 8 has a rectangular cross section with no projections and coincident with the constant section of second portion 9.

The variation in section of first portion 8 is such as to reproduce the thermal contraction of the metal as it is fed, and cools, along portion 8. For which purpose, in a preferred embodiment of the invention, the variation in section of first portion 8 and the corresponding variation in the radius of curvature of inner edges 5 are not linear variations.

Also, the longitudinal extension of variable-section first portion 8 is preferably roughly equal to that of constant-section second portion 9. According to a preferred embodiment, the longitudinal extension of first portion 8 is less than, e.g. 95% of, the longitudinal extension of second portion 9.

In a typical embodiment, purely by way of a non-limiting example, first portion 8 and second portion 9 have respective lengths $L_1$=450 mm and $L_2$=600 mm; which lengths, like all the other distances indicated below, are measured along an axis parallel to flat walls 3 (as opposed to a longitudinal axis of conduit 2, which, as stated, may be curved as shown in FIG. 1).

As such, the radius of curvature of edges 5 at the molten metal input end 7 is $R_1$=11 mm; at an intermediate section 13 (FIG. 1) of portion 8, at a distance $L_3$=240 mm from end 7 (again measured along an axis parallel to flat walls 3), the radius of curvature assumes an intermediate value of 10.4 mm; and, at end 11 of portion 8 (that is, at a distance $L_1$=450 mm from end 7, or at a distance $L_4$=210 mm from intermediate section 13), the radius of curvature equals minimum value $R_2$=10 mm, which is then maintained along the whole length of second portion 9 up to the output end 10 of conduit 2. The ratio between the variation in the radius of curvature and the distance from the molten metal input end 7 of portion 8 is therefore not constant along portion 8, but decreases alongside the distance from end 7: in the example shown, in which intermediate section 13 divides portion 8 into a first portion 14 and a second portion 15 of different lengths, the ratio is roughly 0.0025 along portion 14 of length $L_3$=240 mm (where the radius of curvature decreases from 11 mm to 10.4 mm), and is roughly 0.002 along portion 15 of length $L_4$=210 mm (where the radius of curvature decreases further from 10.4 mm to 10 mm).

In this example embodiment, the variation in the radius of curvature of edges 5, as opposed to being a linear function of the distance from molten metal input end 7 of conduit 2, is obviously such as to reproduce the variation in section of the molten metal as it cools (is therefore a function of the thermal contraction of the metal).

The dimensions of pairs of walls 3 and 4 may obviously be selected to obtain finished products of predetermined size. In particular, to form square-section billets, the ratio between the width of flat walls 3 and the width of curved walls 4 is preferably 1:1.01.

Clearly, changes may be made to the ingot mold as described above without, however, departing from the scope of the accompanying Claims.

What is claimed is:

1. An ingot mold (1) for continuous casting of molten metal for forming rectangular- or square-section steel billets, comprising a longitudinally elongated casting conduit (2) through which said molten metal flows and is cooled; said casting conduit (2) having a rectangular cross section, and being defined by a first (3) and a second (4) pair of parallel, side by side walls; said first (3) and said second (4) pair of walls being perpendicular to one another, and defining four inner edges (5);

said casting conduit (2) comprising at least a first portion (8) having rounded inner edges (5) and an inner section varying gradually from a respective longitudinal first end (7), at which said molten metal is fed in, towards a respective longitudinal second end (11) opposite the first;

wherein said at least a first portion (8) is provided with four funnel-shaped portions (12) which project transversely and are located at said four edges (5) defined by said pairs of walls (3, 4); said funnel-shaped portions (12) extending longitudinally from said first end (7) to said second end (11) of said at least a first portion (8) and tapering towards said second end (11), at which said at least a first portion (8) has a rectangular cross section with no projections;

said variation in section of said at least a first portion (8) being determined by a corresponding continuous, gradual variation in the inner radius of curvature of said four funnel-shaped portions (12); said radius of curvature decreasing from a maximum value (R1) at said first end (7), to a minimum value (R2) at said second end (11).

2. An ingot mold as claimed in claim 1, wherein said inner radius of curvature of said four funnel-shaped portions (12) decreases from said maximum value (R1) to said minimum value (R2) in such a way as to reproduce a thermal condition of said molten metal as it travels through, and partly solidifies in, said at least a first portion (8).

3. An ingot mold as claimed in claim 1, characterized in that said variation in section of said at least a first portion (8) and said corresponding variation in said radius of curvature of said rounded inner edges (5) are nonlinear functions of the distance from said first end (7) of said at least a first portion (8).

4. An ingot mold as claimed in claim 1, wherein said funnel-shaped portions (12) has a transverse extension equal to roughly one tenth of the width of said walls (3, 4).

5. An ingot mold as claimed in claim 1, characterized in that said minimum value ($R_2$) of said radius of curvature is an optimum value for subsequently rolling the solidified metal issuing from said casting conduit (2).

6. An ingot mold as claimed in claim 3, characterized in that the ratio between said variation in the radius of curvature of said edges (5) between two predetermined sections of said at least a first portion (8) and a distance between said two predetermined sections is roughly 0.0025 along a first part (14) of said at least a first portion (8), and is roughly 0.002 along a second part (15), consecutive with the first part in the flow direction of said molten metal in said casting conduit (2), of said at least a first portion (8); said second part (15) having a longitudinal extension roughly 12% shorter than the longitudinal extension of said first part (14).

7. An ingot mold as claimed in claim 1, characterized in that said casting conduit (2) also comprises a second portion (9) having a substantially rectangular inner section of constant area, and defined by respective perpendicular extensions of said pairs of walls (3, 4); said second portion (9) being consecutive with said at least a first portion (8), and having a molten metal input section (11) coincident with a molten metal output section of said at least a first portion (8); said second portion (9) having rounded inner edges (5) with a radius of curvature which is constant along the whole longitudinal extension of said second portion (9) and equal to said minimum value ($R_2$) of the radius of curvature.

8. An ingot mold as claimed in claim 7, characterized in that said at least a first portion (8) has a longitudinal extension roughly equal to the longitudinal extension of said second portion (9).

9. An ingot mold as claimed in claim 8, characterized in that said at least a first portion (8) has a longitudinal extension shorter than the longitudinal extension of said second portion (9).

10. An ingot mold as claimed in claim 1, characterized in that said casting conduit (2) is curved; the walls of said first pair of substantially parallel, side by side walls (3) being flat; and the walls in said second pair of substantially parallel, side by side walls (4) having a predetermined curvature.

11. An ingot mold as claimed in claim 10, characterized in that the ratio between the width of said flat walls in said first pair of walls (3) and the width of said curved walls in said second pair of walls (4) is 1:1.01.

12. An ingot mold (1) for continuous casting of molten metal for forming rectangular- or square-section billets, comprising a longitudinally elongated casting conduit (2) through which said molten metal flows and is cooled; said casting conduit (2) having a rectangular cross-section and being defined by a first (3) and a second (4) pair of side by side walls perpendicular to one another and defining therebetween four inner edges (5); said casting conduit comprising a first portion (8) wherein said inner edges (5) are rounded, the inner section of said first portion (8) varying gradually from a respective longitudinal first end (7), at which said molten metal is fed in, towards a respective longitudinal second end (11) opposite the first; wherein, in combination:

(a) the walls of each pair of said first and second walls (3, 4) are parallel to each other;

(b) said first portion (8) is provided with four funnel-shaped portions (12) which project transversely and are located at said four rounded edges (5) defined between said pairs of walls (3, 4), said funnel-shaped portions (12) extending longitudinally from said first end (7) to said second end (11) of said first portion (8) and tapering towards said second end (11), at which said first portion has said rectangular cross-section and no projections;

(c) said variation in section of said first portion (8) is determined by a corresponding continuous, gradual variation in the inner radius of curvature of said four funnel-shaped portions (12), said inner radius decreasing from a maximum value (R1) at said first end (7) to a minimum value (R2) at said second end (11);

(d) said first portion (8) comprising a first (14) and a second (15) longitudinal part consecutive to each other in the flow direction of said molten metal in said casting conduit (2), a first ratio between said variation in the radius of curvature of said edges (5) in said first part (14) of said first portion (8) and the length (L3) of said first part (14) of said first portion (8) being different from a second ratio between said variation in the radium of curvature of said edges (5) in said second part (14) of said first portion (8) and the length (L4) of said second part (14) of said first portion (8).

13. An ingot mold (1) as claimed in claim 12, wherein said first ratio in said first part (14) of said first portion (8) of the mold is equal roughly to 0.0025, while the second ratio in said second part (15) of said first portion (8) of the mold is equal to roughly 0.002; said second part (15) having a longitudinal extension roughly 12% shorter than the longitudinal extension of said first part (14).

14. An ingot mold (1) as claimed in claim 12, wherein said variation in said radius of curvature of said rounded edges (5) of said first portion (8) is a non-linear function of the distance from said first end (7) of said first portion (8).

* * * * *